US008022378B2

(12) United States Patent
Cadwalader et al.

(10) Patent No.: US 8,022,378 B2
(45) Date of Patent: Sep. 20, 2011

(54) STANDOFF RADIATION ATTENUATION SYSTEM

(75) Inventors: John A. Cadwalader, Overland Park, KS (US); William W. Orrison, Las Vegas, NV (US)

(73) Assignee: Worldwide Innovations & Technologies, Inc., Overland Park, KS (US)

( * ) Notice: Subject to any disclaimer, the term of this patent is extended or adjusted under 35 U.S.C. 154(b) by 204 days.

(21) Appl. No.: 12/348,785

(22) Filed: Jan. 5, 2009

(65) Prior Publication Data

US 2009/0108217 A1 Apr. 30, 2009

Related U.S. Application Data

(60) Continuation of application No. 11/796,764, filed on Apr. 30, 2007, now Pat. No. 7,473,919, which is a division of application No. 10/997,777, filed on Nov. 24, 2004, now Pat. No. 7,211,814.

(51) Int. Cl.
*G21F 3/00* (2006.01)
*G21F 1/12* (2006.01)

(52) U.S. Cl. ..... 250/515.1; 250/516.1; 250/519.1; 250/503.1; 378/185; 128/846

(58) Field of Classification Search ..... 250/515.1, 250/516.1, 503.1, 519.1; 378/185; 128/846
See application file for complete search history.

(56) References Cited

U.S. PATENT DOCUMENTS 3,419,006 A 12/1968 King
3,514,607 A 5/1970 Webster
3,935,099 A 1/1976 Weaver et al.
4,286,170 A 8/1981 Moti
4,558,093 A 12/1985 Hatzenbuhler et al.
4,621,808 A 11/1986 Orchard et al.
4,670,658 A 6/1987 Meyers
4,938,233 A 7/1990 Orrison, Jr.
5,247,182 A 9/1993 Servant et al.
5,278,219 A 1/1994 Lilley et al.
5,417,225 A 5/1995 Rubenstein et al.
5,523,581 A 6/1996 Cadwalader
5,525,408 A 6/1996 Weir et al.
5,548,125 A 8/1996 Sandbank (Continued)

FOREIGN PATENT DOCUMENTS

DE 30 17 640 A1 11/1981

(Continued)

OTHER PUBLICATIONS

Promotional material titled Xenolite Radiation Protection Garments by DuPont Technology "Less Weight . . . Full Protection," Manufactured by Lite Tech, Inc., 18 Depot Street, Bridgeport, PA 19405, undated (6 sheets,).

(Continued)

*Primary Examiner* — Nikita Wells
(74) *Attorney, Agent, or Firm* — Foley & Lardner LLP

(57) ABSTRACT

A system for attenuating a primary radiation beam applied to a target area on a patient for generating an image of the target area during a radiological procedure is disclosed. The system includes a radiation attenuation material positionable over the target area to partially attenuate the primary radiation beam before the primary radiation beam reaches the target area. The system also includes a buffer positionable between the radiation attenuation material and the target area. The buffer is formed of a polymeric material and is configured to improve the clarity of the generated image.

16 Claims, 9 Drawing Sheets

U.S. PATENT DOCUMENTS

| | | | | |
|---|---|---|---|---|
| 6,048,379 | A | 4/2000 | Bray et al. | |
| 6,153,666 | A | 11/2000 | Lagace | |
| 6,320,938 | B1 | 11/2001 | Hopper | |
| 6,429,432 | B1 | 8/2002 | McNaught et al. | |
| 6,481,888 | B1 | 11/2002 | Morgan | |
| 6,674,087 | B2 * | 1/2004 | Cadwalader et al. | 250/515.1 |
| 7,099,427 | B2 * | 8/2006 | Cadwalader et al. | 378/4 |
| 7,211,814 | B2 * | 5/2007 | Cadwalader et al. | 250/519.1 |
| 7,473,919 | B2 * | 1/2009 | Cadwalader et al. | 250/519.1 |
| 7,767,990 | B2 * | 8/2010 | Cadwalader et al. | 250/519.1 |
| 2002/0148980 | A1 | 10/2002 | Cadwalader et al. | |

FOREIGN PATENT DOCUMENTS

| | | | |
|---|---|---|---|
| DE | 91 03 451 | U1 | 9/1991 |
| FR | 2 439 460 | A1 | 5/1980 |

OTHER PUBLICATIONS

International Search Report and Written Opinion for Application No. PCT/US2005/042685, mailing date Apr. 10, 2006, date received Apr. 13, 2006, 14 pages.

Fricke et al., "In-Plane Bismuth Breast Shields for Pediatric CT: Effects on Radiation Dose and Image Quality Using Experimental and Clinical Data", American Journal of Roentgenology, vol. 180, Feb. 2003, pp. 407-411 (5 pages).

Notice of Allowance for U.S. Appl. No. 10/997,777, mail date Jan. 10, 2007, 4 pages.

Notice of Allowance for U.S. Appl. No. 11/796,764, mail date Sep. 8, 2008, 4 pages.

Office Action for U.S. Appl. No. 10/997,777, mail date Sep. 22, 2006, 6 pages.

Office Action for U.S. Appl. No. 11/796,764, mail date Mar. 27, 2008, 7 pages.

Office Action for U.S. Appl. No. 90/010,808, mail date Jul. 7, 2010, 8 pages.

Office Action for U.S. Appl. No. 90/010,808, mail date Oct. 27, 2010, 6 pages.

Office Action for U.S. Appl. No. 90/010,809, mail date Jul. 7, 2010, 7 pages.

Printout of copyright registration data for the Feb. 2003 issue of the American Journal of Roentgenology obtained from the U.S. Copyright Office searchable copyright registrations database indicating publication data of Jan. 22, 2003, 2 pages.

Request for Ex Parte Reexamination of U.S. Patent No. 7,473,919 including exhibits, filed Jan. 5, 2010, 77 pages.

Request for Ex Parte Reexamination of U.S. Patent No. 7,211,814 including exhibits, filed Jan. 5, 2010, 123 pages.

* cited by examiner

STANDOFF RADIATION ATTENUATION SYSTEM

CROSS REFERENCE TO RELATED PATENT APPLICATIONS

The present Application is a continuation application of U.S. application Ser. No. 11/796,764, filed Apr. 30, 2007, now U.S. Pat. No. 7,473,919 (issued Jan. 6, 2009), which is a divisional application of U.S. application Ser. No. 10/997,777, filed Nov. 24, 2004, now U.S. Pat. No. 7,211,814 (issued May 1, 2007), the entire disclosures of which are hereby incorporated by reference.

BACKGROUND

The present disclosure relates generally to systems (e.g., drapes, shields, protective pads, garments, etc.) configured to attenuate radiation. More particularly, the present disclosure relates to attenuation systems suitable for attenuating radiation during a radiological examination.

Radiation barriers or shields are used to attenuate (e.g., deflect, absorb, etc.) the flux of electromagnetic radiation originating from a radiation source and directed towards an article (e.g., sample, room, human body, or part thereof, etc.). Radiation can be provided from a variety of natural or man-made sources and can be electromagnetic energy at wavelengths of $1.0\times10^{-15}$ meters (e.g., cosmic rays) to $1.0\times10^{6}$ meters (e.g., radiation from AC power lines). Radiation can have beneficial and/or negative effects.

One beneficial effect of radiation relates to radiological examinations. The phrase radiological examination, for purposes of this disclosure, refers generally to any procedure wherein radiation is applied to an article for the purpose of producing an image or representation of the article. Radiological examinations may provide a non-invasive means capable of obtaining an image of the internal composition of the article. Radiological examinations may be employed in a variety of applications including, but not limited to, medical procedures.

A wide array of medical procedures exist where radiological examinations are employed to obtain an image of the anatomy of a patient or portions thereof. For example, portions of a patient's anatomy may be irradiated during: (i) diagnostic procedures (e.g., Computed Tomography (CT) scanning, x-ray photography, or any other imaging procedure) allowing non-invasive investigation of anatomical regions of a patient (e.g., internal tissue, organs, etc.); or (ii) various invasive procedures, such as the fluoroscopic guidance and/or manipulation of instruments during surgical procedures (e.g., CT fluoroscopy, etc.).

To obtain an image through a radiological examination, a primary radiation beam (i.e., entrance radiation) is be applied to the article (e.g., patient). Preferably, radiation is selectively applied only to those areas to be examined (i.e., target areas) to minimize the article's overall radiation exposure. Typically, the target areas of the article are directly irradiated without any obstruction or impairment provided between the primary radiation beam and the surface of the article. It is generally known to cover those areas not being examined (i.e., secondary areas) with a radiation barrier or shield to prevent and/or reduce radiation exposure for those areas. Such shields are formed of a radiation attenuating material and are often placed directly upon the surface of the article.

It has been discovered that in certain procedures limited imaging of the article can still be generated when a barrier or shield (made of a radiation attenuating material) is placed over the target area (i.e., coincident with the primary radiation beam). The radiation attenuation material absorbs much of the primary radiation beam, but allows an amount (sufficient to generate an image of the article) to penetrate through and subsequently penetrate the article. Placing the shield over the target area reduces the amount of radiation exposure realized by the article. This method of reducing radiation exposure may be particularly beneficial during fluoroscopy procedures during which particularly sensitive areas (e.g., male or female reproductive regions, female breast tissue, etc.) of a patient are exposed to a primary radiation beam.

However, it has further been discovered that it is often difficult (if not impossible) to sufficiently examine certain regions of the article when a radiation attenuation material is positioned coincident with the primary radiation beam and over the target area. For example, placing a radiation attenuation material on the surface of the article prevents a clear and/or accurate image of the surface (or regions slightly below the surface) from being obtained. Such examination limitations are due to x-ray glare (e.g., noise, scatter, artifact, etc.), referred to in this disclosure generally as interference, generated when radiation encounters the radiation attenuation material. This interference hinders a worker's (e.g., physician's) ability to visualize the necessary regions and therefore cannot be used during the radiological examination.

Accordingly, it would be advantageous to provide a radiation attenuation system that may be used during a radiological examination to reduce the amount of radiation exposure realized by an article undergoing the examination. It would further be advantageous to provide a radiation attenuation system that may be positioned coincident to the primary radiation beam to protect the target area (i.e., the area of examination) from increased radiation exposure. It would further be advantageous to provide a radiation attenuation system that may be used during a radiological examination without allowing the interference (caused when radiation encounters a radiation attenuation material) from interfering with the clarity and/or accuracy of the generated image of an article. It would further be advantageous to provide a radiation attenuation system that reduces the amount of radiation exposure for personnel present during a radiological examination. It would also be advantageous to provide a radiation attenuation system that is relatively adaptable for use with a variety of radiological examinations. It would be desirable to provide for a radiation attenuation system having one or more of these or other advantageous features.

SUMMARY

One exemplary embodiment relates to a system for attenuating a primary radiation beam applied to a target area on a patient for generating an image of the target area during a radiological procedure. The system includes a radiation attenuation material positionable over the target area to partially attenuate the primary radiation beam before the primary radiation beam reaches the target area. The system also includes a buffer positionable between the radiation attenuation material and the target area. The buffer is formed of a polymeric material and is configured to improve the clarity of the generated image.

Another exemplary embodiment relates to a shield for attenuating a primary radiation beam applied to a target area on a patient for generating an image of the target area during a radiological procedure. The shield includes a radiation attenuation material positionable over the target area to partially attenuate the primary radiation beam before the primary radiation beam reaches the target area. The radiation attenuation material has a first surface through which the primary radiation beam is configured to enter and a second surface through which the primary radiation beam is configured to exit. The shield also includes a buffer bonded to the second surface of the radiation attenuation material. The buffer is formed of a relatively non-radiation attenuation material and is configured to improve the clarity of the generated image.

Another exemplary embodiment relates to a breast shield for attenuating a primary radiation beam applied to a target area on a female patient for generating an image of the target area during a radiological procedure. The breast shield includes a radiation attenuation material positionable over the target area to partially attenuate the primary radiation beam before the primary radiation beam reaches the target area. The radiation attenuation material has a first surface through which the primary radiation beam is configured to enter and a second surface through which the primary radiation beam is configured to exit. The radiation breast shield also includes a buffer coupled to the second surface of the radiation attenuation material. The buffer is formed of a foam material and is configured to improve the clarity of the generated image.

DETAILED DESCRIPTION

Figure 1:
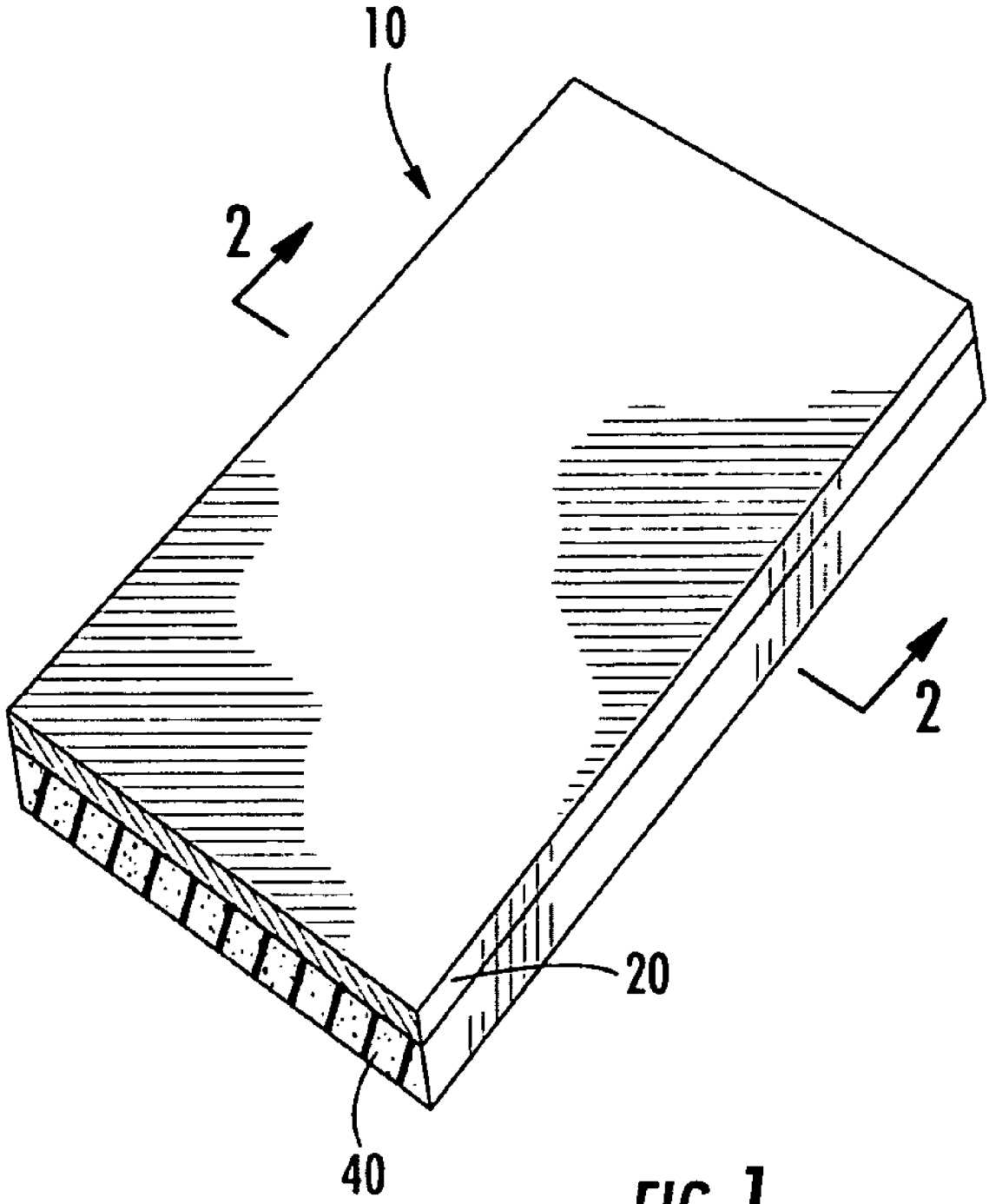
FIG. 1 is a schematic perspective view drawing of a radiation attenuating system according to an exemplary embodiment.

A radiation attenuation system which can be readily used to attenuate radiation and allow for a radiological examination in a number of applications, environments, and configurations is disclosed. Generally the system includes a first portion (e.g., region, zone, area, layer, etc.) for attenuating radiation applied an article and a second portion for buffering (e.g., displacing, offsetting, elevating, spacing apart, etc.) the first portion from the surface of the article (e.g., a specimen, the anatomy of a patient or portions thereof, etc.) undergoing the radiological examination.

By providing a buffer region (i.e., the second portion) between the first portion and the article surface, improved examination (e.g., visualization, imaging, image capturing, image displaying, etc.) of the article can be achieved. For example, providing a buffer region between the radiation attenuating portion and the surface of the article may allow for examination of internal regions of the article as well as other regions of the article (e.g., surface regions, regions slightly below the surface of the article, etc.) that may otherwise be difficult to examine due to glare (e.g., noise, scatter, artifact, etc.), referred to in this disclosure generally as interference, generated when radiation encounters the radiation attenuating portion.

Referring to FIGS. 1 through 14*b*, radiation attenuation systems and components thereof are shown according to exemplary embodiments. The systems disclosed herein provide a relatively convenient and functionally integrated means of attenuating radiation while allowing for a thorough examination of multiple regions of the article. The systems are applicable for use with any radiological examination procedure wherein radiation is applied to an article for the purposes of producing an image of the article. While the systems will be described as protecting a patient during a medical procedure, the scope of the appended claims is intended to encompass systems employed in any application (not limited to medical applications) that uses radiation to generate an image of an article.

The systems may be used with any medical procedure (e.g., fluoroscopy procedures, Computed Tomography (CT) procedures (e.g., invasive (fluoroscopy) and/or noninvasive (scanning)), x-ray photography procedures, and/or any other image producing medical procedure using radiation, etc.) involving a radiological examination wherein radiation is applied to the anatomy of a patient (or portions thereof) to generate an image on an appropriate display (e.g., monitor, screen, x-ray film, etc.). The radiation attenuation system can be placed upon, near, under, or otherwise about the patient undergoing the radiological examination. The radiation attenuation system lessens or otherwise reduces the amount of radiation (e.g., primary radiation beam, incidental scatter radiation, etc.) realized by a patient and/or personnel (e.g., physicians, surgeons, technicians, etc.) present during the procedures.

FIG. 1 shows a radiation attenuation system 10 suitable for at least partially covering a patient during a procedure involving a radiological examination. According to one embodiment, radiation attenuation system 10 is intended to be positioned (e.g., disposed, supported, placed, etc.) coincident with (e.g., in line with) a primary radiation beam to attenuate the primary radiation beam before reaching a target area (i.e., the area of examination) of a patient. Radiation attenuation system 10 attenuates only a portion of the radiation and allows an amount of radiation sufficient to generate an image to penetrate the system (and subsequently the patient) to generate an image that can be viewed by a worker (e.g., surgeon, physician, technician, etc.). In this manner, radiation attenuation system 10 reduces a patient's radiation exposure by protecting the target area of the patient which is traditionally exposed (e.g., uncovered, unprotected, etc.) to the primary radiation beam.

In addition to protecting a patient, radiation attenuation system 10 may also protect one or more individuals present during the radiological examination (e.g., physicians, surgeons, technicians, etc.). Individuals present during a radiological examination may also be susceptible to radiation exposure from the primary radiation beam (e.g., during a fluoroscopy procedure, etc.), but are more likely to be susceptible to radiation exposure from incidental scatter radiation. Radiation attenuation system 10 protects against scatter radiation by absorbing at least a portion of the primary radiation beam and scatter radiation.

Figure 2:
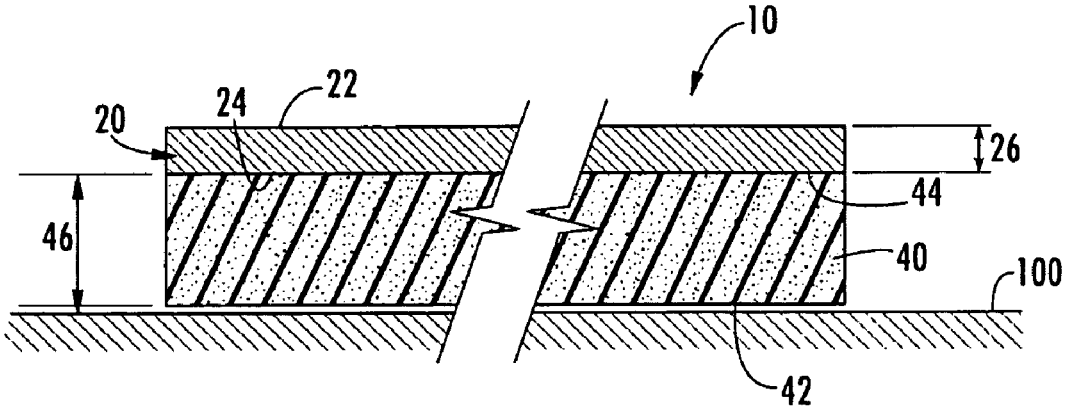
FIG. 2 is a schematic partial cross-sectional view drawing of the radiation attenuating system shown in FIG. 1, taken along the line 2-2.

FIG. 2 shows a partial cross sectional view of radiation attenuation system 10 according to one embodiment. Radiation attenuation system 10 generally includes a first portion or layer (e.g., platform, web, matrix, film, shield, pad, radiation attenuating material, etc.), shown as a barrier 20, and a second portion or layer (e.g., filler, spacer, lifter, relatively non-radiation attenuating material, etc.), shown as a buffer 40. The attenuation of radiation is provided by barrier 20, while buffer 40 provides a non-radiation attenuating boundary or zone between barrier 20 and the surface of the patient.

Barrier 20 may be configured to attenuate the flux of electromagnetic radiation over a broad wavelength range depending on the intended application. For example, barrier 20 may attenuate radiation from wavelengths of around $1.0\times10^{-15}$ meters (e.g., cosmic rays) to around $1.0\times10^{6}$ meters (e.g., radiation from AC power lines) including visible and invisible light, and may find incidental uses at relatively low or high frequency extremes (including gamma rays). The degree of radiation transmission attenuation factor by barrier 20 will depend in part on the specific application to which radiation attenuation system 10 is utilized.

According to one embodiment, barrier 20 has a radiation attenuation factor of a percent (%) greater than about 10% of a primary 100 kVp x-ray beam. According to other suitable embodiments, barrier 20 has a radiation attenuation factor of a percent of about 10-50%. According to further suitable embodiments, barrier 20 has a radiation attenuation factor greater than about 50%, suitably greater than about 90%, suitably greater than about 95%. According to a preferred embodiment, barrier 20 has a radiation attenuation factor of around 20-60%. According to still further suitable embodiments, barrier 20 may have radiation attenuation factors less than 10% or greater than 95% depending on the application. Barrier 20 may also at least partially attenuate gamma rays, and may have a gamma ray attenuation fraction of at least about 10% of a 140 keV gamma radiation source.

Barrier 20 may be fabricated from of any radiation attenuation material including, but not limited to, bismuth, barium, lead, tungsten, antimony, copper tin, aluminum, iron, iodine, cadmium, mercury, silver, nickel, zinc, thallium, tantalum, tellurium, and/or uranium. Anyone of the aforementioned attenuation materials alone or in a combination of two or more of the attenuation materials may provide the desired attenuation.

Barrier 20 may have a composition that includes only a radiation attenuation material or combinations thereof, or alternatively, barrier 20 may have a composition that includes a combination of a radiation attenuation material and a non-radiation attenuating material. For example, barrier 20 may include one or more radiation attenuation materials compounded (e.g. mixed, blended, alloyed, dispersed, layered, etc.) with a relatively non-radiation attenuating carrier material. According to one embodiment, barrier 20 has a composition similar to the radiation attenuation system disclosed in U.S. Pat. No. 4,938,233, which is hereby incorporated by reference in its entirety. According to another embodiment, barrier 20 has a composition similar to the radiation attenuation system disclosed in U.S. Pat. No. 6,674,087, which is hereby incorporated by reference in its entirety. However, it should be noted that barrier 20 is not limited to such embodiments. Barrier 20 be provided as a relatively single body, or alternatively may include a plurality of members (e.g., multiple layers of attenuating films or sheets stacked (e.g., overlapping) relative to each other).

According to one embodiment, barrier 20 is a relatively light weight and flexible. Configuring barrier 20 as a flexible member allows provides for optimized workability for processing, bending, folding, rolling, shipping, etc. Barrier 20 may be formable (e.g. deformable) or compliant, and relatively "stretchable" (e.g. elastic). In this manner, barrier 20 can advantageously conform to the contours of a patient when placed thereon. According to alternative embodiments, barrier 20 may be generally rigid and inflexible, and/or substantially weighted.

Still referring to FIG. 2, barrier 20 includes a first surface 22 (e.g., outer surface, upper surface, etc.) and a second surface 24 (e.g., inner surface, lower surface, etc.). The primary radiation beam enters radiation attenuation system 10 through first surface 22 of barrier 20 and does not penetrate a target area on the patient until passing through second surface 24 of barrier 20. The amount of radiation penetrating the target area (radiation exiting second surface 24 of barrier 20) is less than if barrier 20 was not provided.

The interaction between the primary radiation beam and barrier 20 generates glare (noise, scatter, artifact, etc.), referred to generally as interference. As mentioned above, such interference traditionally limited the use of radiation barriers or shields over or near the target area. To prevent the interference from degrading the clarity and/or accuracy of an image generated by a radiological examination, radiation attenuation system 10 includes buffer 40.

As illustrated in FIG. 2, buffer 40 is provided between barrier 20 and a surface 100 of the patient. Buffer 40 provides a relatively non-radiation attenuating boundary or zone between barrier 20 and surface 100 of the patient. Providing a non-radiation attenuating zone between barrier 20 and surface 100 of the patient is intended to allow for a thorough examination of the surface regions of the patient or region slightly below the surface that would otherwise be non-viewable due to the interference generated when the radiation encounters barrier 20. Buffer 40 offsets barrier 20 from surface 100 a distance sufficient so that the interference does not prevent a readable image from being obtained. Buffer 40 may also advantageously reduce the radiation dose leaving the patient by providing increased absorption.

Buffer 40 is formed of one or more relatively non-radiation attenuating materials. While buffer 40 may attenuate a certain amount of radiation, it is chosen for having relatively low radiation attenuating properties in comparison to barrier 20. In one embodiment, buffer 40 is formed of a polymeric material such as a foam material (e.g., closed cell foam, open cell foam, etc.). According to various other suitable embodiments, buffer 40 may be formed of a variety of other non-radiation attenuation materials including, but not limited to, any woven or non-woven textile, cloth, fiber, vinyl, nylon, gel, fluid, gas (e.g., bubble wrap, etc.), etc. Anyone of the aforementioned relatively non-radiation attenuation materials alone or in a combination of two or more of the non-radiation attenuation materials may provide the desired buffer 40.

FIG. 2 shows buffer 40 as having a first surface 42 and a second surface 44. According to an exemplary embodiment, second surface 44 of buffer 40 is positioned adjacent to second surface 24 of barrier 20, while first surface 42 of buffer 40 is intended to be positioned adjacent to surface 100. Second surface 44 of buffer 40 may contact second surface 24 of barrier 24, or alternatively, an intermediate layer or gap may be provided between second surface 24 of barrier 20 and second surface 44 of buffer 40. Similarly, first surface 42 of buffer 40 may be configured to contact surface 100 of the patient, or alternatively, an intermediate layer (e.g., a cover material, etc.) or gap may be provided between first surface 42 of buffer 40 and surface 100.

Barrier 20 is offset (e.g., spaced-apart) from surface 100 a distance 46 necessary to obtain an image of the patient. Distance 46 depends on a number of factors such as the radiation attenuation factor of barrier 20, physical characteristics of the patient (e.g., size, weight, etc.), and/or the region of the patient being examined (e.g., slightly below the surface, internal portions, etc.). According to an exemplary embodiment, buffer 20 has a height or thickness 47 sufficient to offset barrier 20 from the surface of the article approximately distance 46 when positioned relative to the patient. According to one embodiment, distance 46 is between approximately 0.1 centimeters and approximately 30 centimeters. According to a preferred embodiment, distance 46 is between approximately 1 centimeter and 10 centimeters. Distance 46 may be defined by thickness 47 of buffer 40 alone, or alternatively, radiation attenuation system 10 may include intermediate or supplemental layers or components (e.g., a cover material, etc.) that further define distance 46.

According to a one embodiment, buffer 40 is coupled to barrier 20. For purposes of this disclosure, the term "coupled" means the joining or combining of two members (e.g., portions, layers, materials, etc.) directly or indirectly to one another. Such joining or combining may be stationary in nature or movable in nature. Such joining may be achieved with the two members or the two members and any additional intermediate members being integrally formed as a single unitary body with one another or with the two members or the two members and any additional intermediate member being attached to one another. Such joining or combining may be permanent in nature or alternatively may be removable or releasable in nature.

Buffer 40 may be coupled (e.g., bonded, fused, adhered, fastened, attached, connected, etc.) to barrier 20 employing any of a variety of suitable techniques. According to other suitable alternative embodiments, barrier 20 may simply be disposed over or supported above buffer 40 without actually being coupled (either directly or indirectly) to buffer 40.

Figure 3:
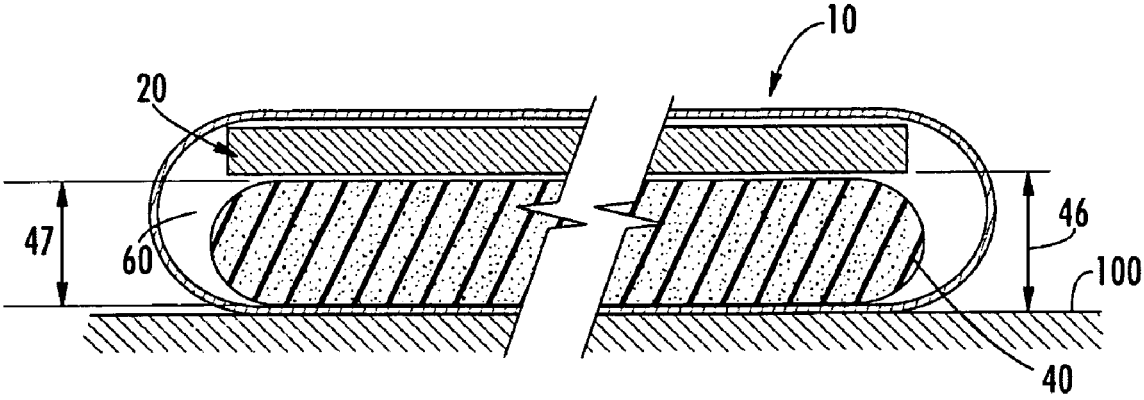
FIG. 3 is a schematic partial cross-sectional view drawing of a radiation attenuating system according to another exemplary embodiment, showing the addition of a cover.

FIG. 3 shows a partial cross sectional view of radiation attenuation system 10 according to another embodiment. In addition to barrier 20 and buffer 40, radiation attenuation system 10, as shown in FIG. 3, further includes a third portion or layer (e.g., housing, casing, coating, skin, outer material, membrane, etc.), shown as a cover 60. Cover 60 forms at least a portion of the exterior portion or surface (e.g., exposed surface, etc.) of radiation attenuation system 10. Cover 60 may be useful in retaining and/or supporting barrier 20 relative to buffer 40, protecting barrier 20 and/or buffer 40 from contaminants (e.g., fluids, particles, etc.), providing enhanced comfort for a patient, and/or, improving the overall durability of radiation attenuation system 10.

Cover 60 is at least partially disposed over or around one of barrier 20 and buffer 40, and is preferably disposed over both barrier 20 and buffer 40. Cover 60 may be provided as a single unitary body integrally formed with barrier 20 and buffer 40, or alternatively, cover 60 may be provided as one or more sections positioned around buffer 20 and/or barrier 40 and coupled together.

Cover 60 may be permanently coupled to barrier 20 and/or buffer 40, or alternatively, may be configured to be detachably coupled. Providing cover 60 as a detachable member may allow barrier 20 and/or buffer 40 to be conveniently interchangeable and/or replaceable.

Figure 4:
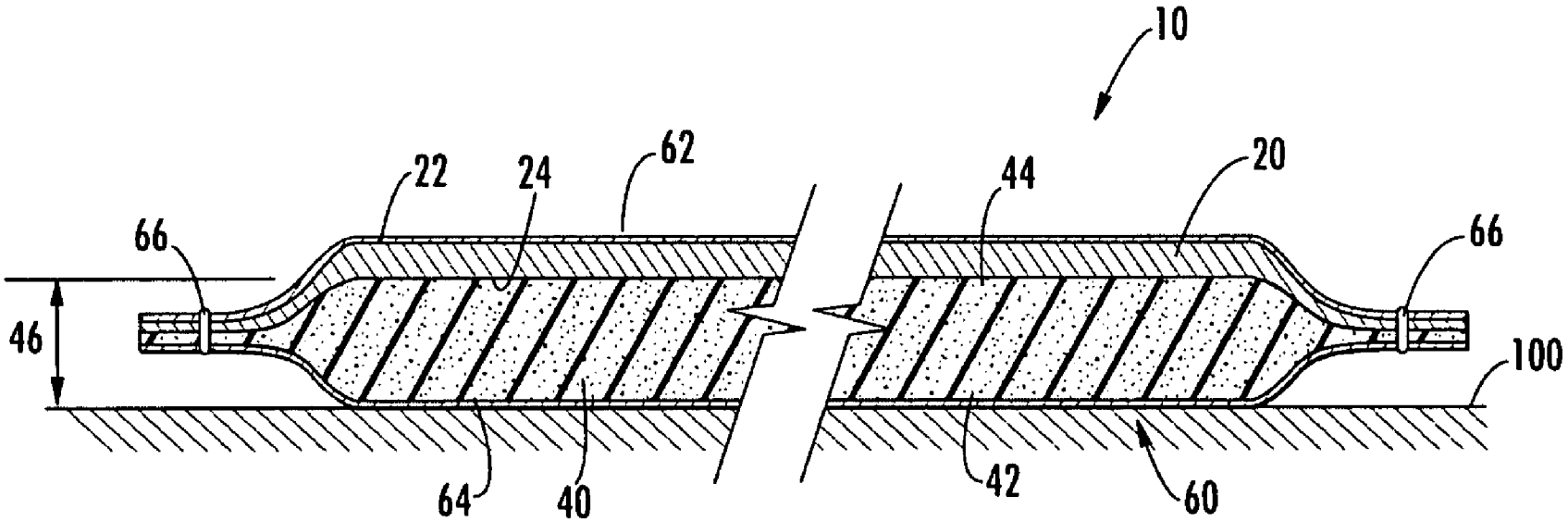
FIG. 4 is a schematic partial cross-sectional view drawing of a radiation attenuating system of FIG. 5, taken along the line 4-4.

FIG. 4 shows a partial cross sectional view of radiation attenuation system according to another embodiment. As shown, cover 60 includes a first section 62 configured to substantially cover barrier 20 and a second section 64 configured to substantially cover buffer 40. First section 62 is coupled to second section 64 along one or more seams 66. According to one embodiment, at least a portion of barrier 20 and/or buffer 40 is captured within seam 66 to assist in retaining barrier 20 and buffer 40 in a desired position. First portion 62 may be coupled to second portion 64 along seam 66 using any suitable technique (e.g., adhesives, welding (e.g., ultrasonic welding, etc.), heat sealing, fasteners (e.g., clips, snaps, buttons, zippers, Velcro, etc.), sewing, etc.).

According to other suitable embodiments, cover 60 may merely surround barrier 20 and/or buffer 40 (e.g., as an envelope, etc.) and need not necessarily be attached to the barrier and/or buffer.

Cover 60 may be made from a variety of materials. For example, cover 60 may be made of a material that is the same or different from the material of buffer 40, a material to enhance processability, softness or comfort for a user, a material that is substantially impervious to fluid, and/or a material having heat sealing properties to assist in the retention of body heat. Cover 60 may be fabricated from a variety of woven or non-woven materials including, but not limited to, polymers, natural fibers (cotton, wool, silk, etc.), nylon, vinyl, or composite materials.

Cover 60 may further include an absorbent layer for maintaining fluid control (e.g., block blood from seeping onto the patient during a surgical procedure, etc.). The absorbent layer may be attached to a relatively liquid impervious layer such as a plastic, polyethylene, etc. The impervious layer may hinder the transmission of fluid from the absorbent layer to cover 60

The size, shape, and configuration of radiation attenuation system 10 may be provided in any number of forms (only a few of which are illustrated in the FIGURES) suitable for at least partially covering an article such as the anatomy of a patient or portions thereof. Referring again to FIG. 1, radiation attenuation system 10 is configured as a substantially rectilinear cover, shield, or drape. Radiation attenuation system 10 could be of sufficient width and length to span entirely across the patient and an operating table, or alternatively could be configured only span across a portion of the patient.

According to an exemplary embodiment, the compliant nature of radiation attenuation system 10 allows it to reside closely next to the body of the patient. It is comfortable and fits positively against the undulating surface of the patient thus improving its stability while the surgical team is operating on the body of the patient. Preferably the coefficient of friction between radiation attenuation system 10 and the surface of the patient adds to that stability, preventing movement of the radiation attenuation system during the surgical procedure and further obviating the need to take extraordinary measures to prevent slippage or movement of the drape.

Figure 5:
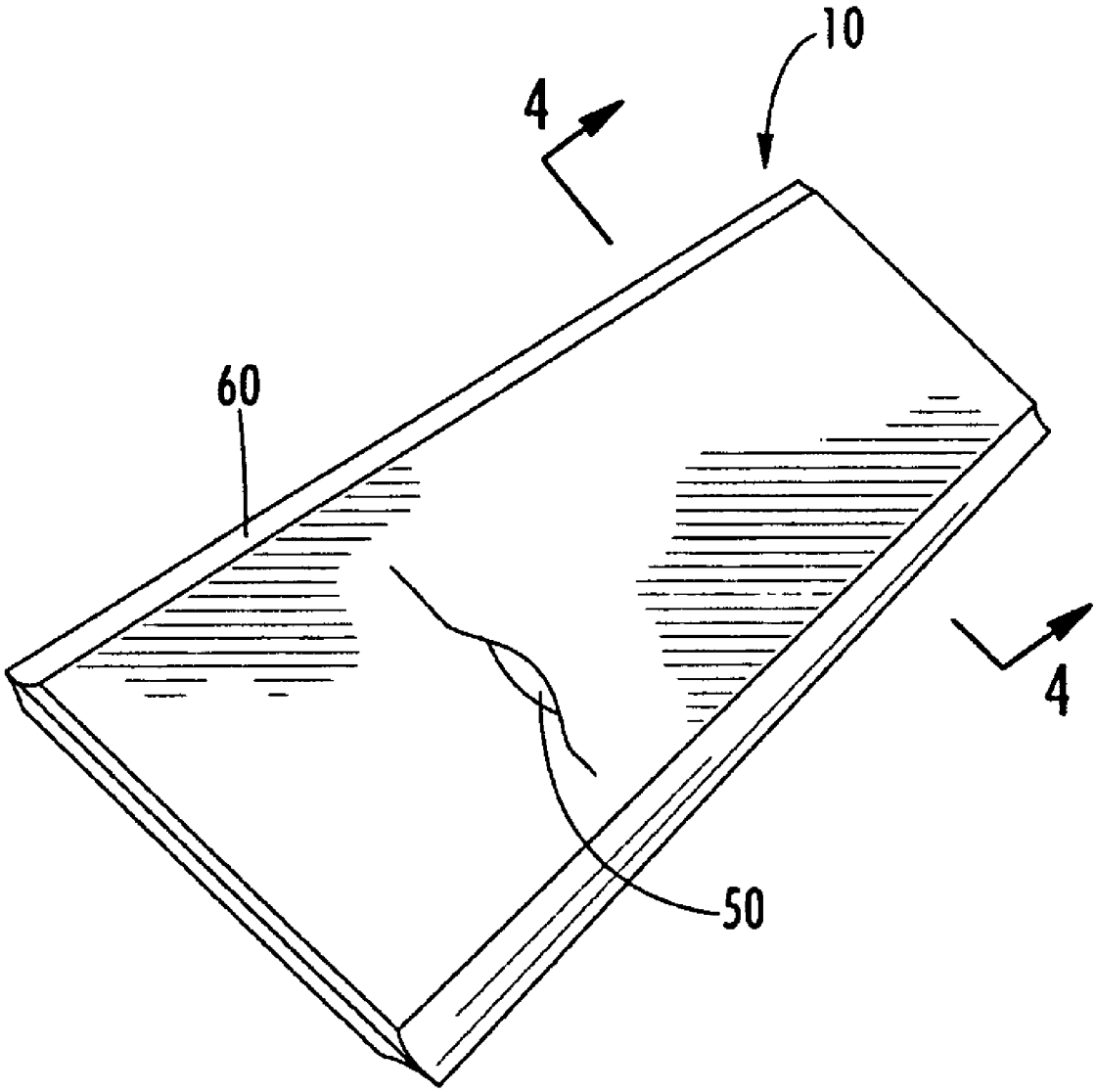
FIG. 5 is a schematic perspective view drawing of a radiation attenuating system according to another exemplary embodiment.

FIG. 5 shows radiation attenuation system 10 according to another embodiment. Radiation attenuation system 10 shown in FIG. 5 is similar to radiation attenuation system shown in FIG. 1, but further includes one or more apertures (e.g., fenestrations, slits, missing portions, keyway, cut-out, etc.), shown as an opening 50. Such an embodiment may be particularly applicable for invasive procedures (e.g., fluoroscopy, etc.) where opening 50 may provide an entry point to introduce and/or manipulate instrumentation.

Figure 6:
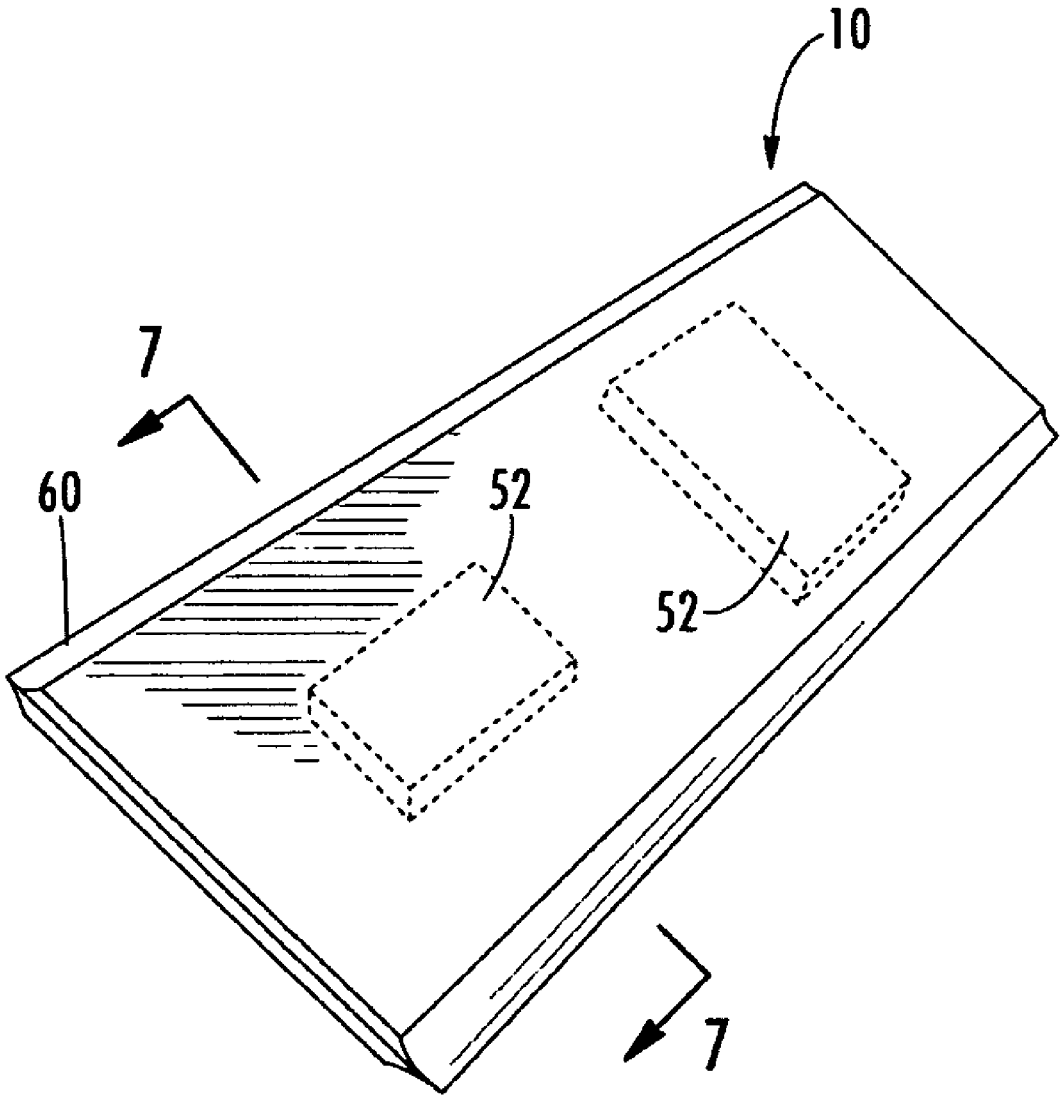
FIG. 6 is a schematic perspective view drawing of a radiation attenuating system according to another exemplary embodiment.
Figure 7:
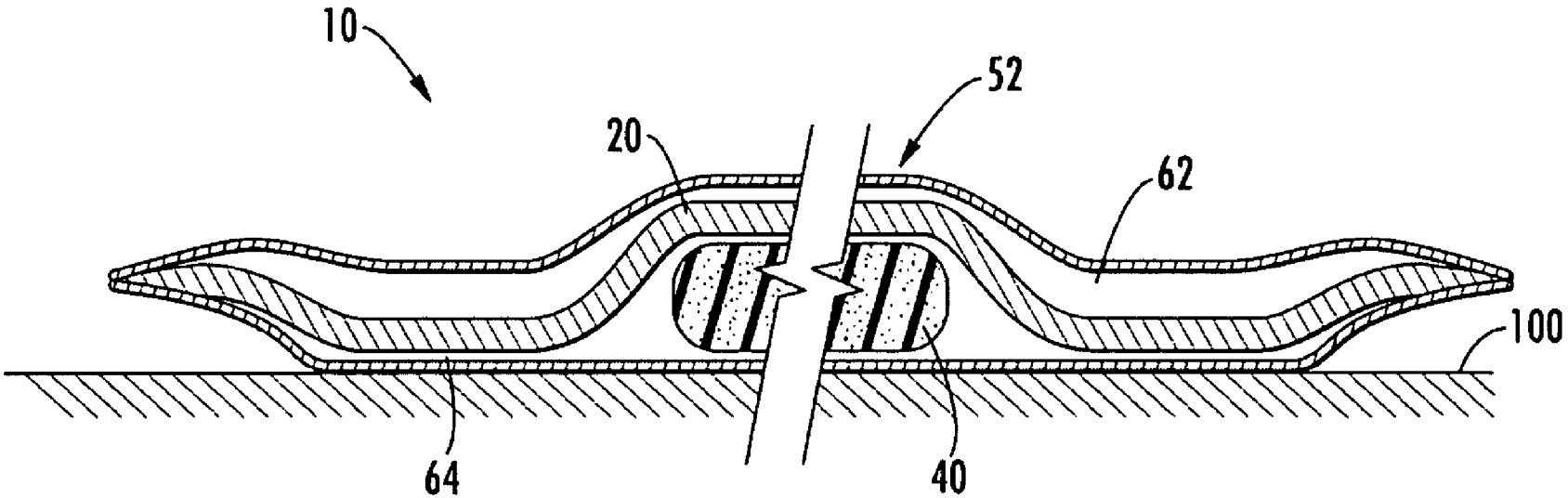
FIG. 7 is a schematic partial cross-sectional view drawing of the radiation attenuating system shown in FIG. 6, taken along the line 7-7.

FIGS. 6 and 7 show radiation attenuation system 10 according to another suitable embodiment. According to such an embodiment, radiation attenuation system 10 is formed having one or more localized or selectively positioned areas or regions 52 (shown in phantom lines) for which buffer 40 is provided. For example, buffer 40 may only be applied as a strip positioned in sensitive areas likely to be examined (e.g., breasts, male and female reproductive areas, thyroid region, eyes, etc.). In this manner, the areas or regions 52 of buffering may be optimized based on the likely requirements of the radiological examination procedure. One advantageous feature of such an embodiment is that materials and manufacturing costs may be reduced and the inefficient use of a buffer material in areas being examined may be eliminated.

According to another suitable embodiment, radiation attenuation system 10 may be configured as a garment or article of clothing. For use with various medical procedures, radiation attenuation system 10 may be configured and incorporated in any number of convenient shapes and sizes including, but not limited to, breast shields, thyroid shields, male gonadal shields, female gonadal shields, aprons (including miniaprons), scoliosis shields, eye shields, etc. Such articles may be provided in a variety of sizes to accommodate a wide range of patients, or alternatively may be provided in only a few sizes that are configured as adjustable articles. Such articles may be worn or draped about a patient during a variety of procedures involving a radiological examinations such as CT procedures, fluoroscopic procedures, x-ray photographs, etc. Exemplary articles of the radiation attenuation shield are shown in FIGS. 8 through 14*b*.

Figure 8:
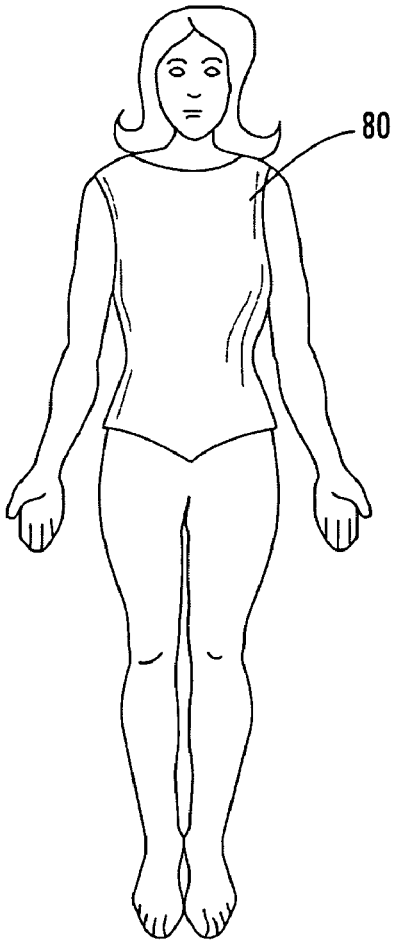
FIG. 8 is a schematic front view drawing of a garment configured as a breast shield according to an exemplary embodiment.

FIG. 8 shows a breast protective barrier drape or shield 80 worn by or placed over a user (e.g. female patient), for example during a mammographic x-ray procedure. Breast shield 80 is thus comprised of a shield which protects the portion of the anatomy of the user that is subjected to examination (i.e., the target area). Breast shield 80 extend downwardly from the body of the user (e.g. from the shoulder toward the abdomen) to provide further shielding of the user (e.g., breast shield 80 may also protect the gonadal region of the user to protect those organs as well). Accordingly, breast shield 80 allows the area traditionally exposed (i.e., the area to be examined) to be protected against increased levels of exposure. Breast shield 80 includes barrier 20 and buffer 40.

Figure 9:
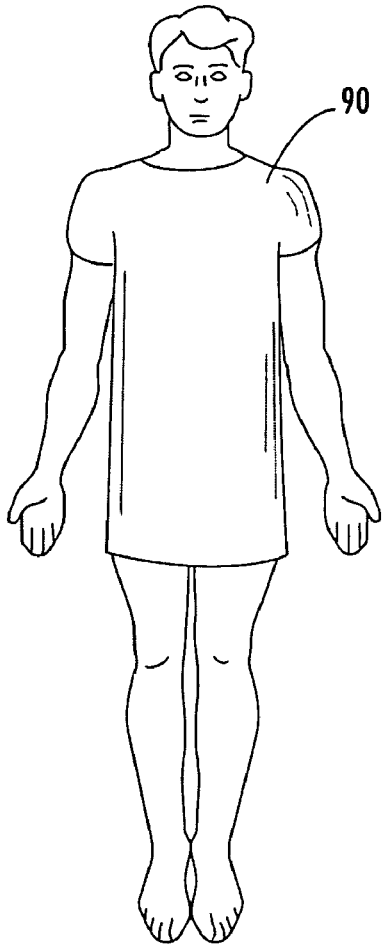
FIG. 9 is a schematic front view drawing of a garment configured as a scoliosis shield according to an exemplary embodiment.

FIG. 9 shows a scoliosis shield 90. Scoliosis shield 90 drapes from the shoulder region of the user (e.g. patient) to the lower abdomen. Scoliosis shield 90 includes barrier 20 and buffer 40.

Figure 10:
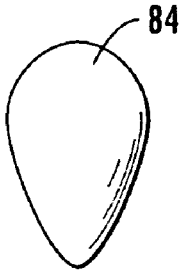
FIG. 10 is a schematic front view drawing of a garment configured as a male gonadal shield according to an exemplary embodiment.
Figure 11:
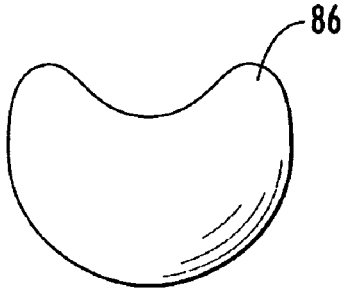
FIG. 11 is a schematic front view drawing of a garment configured as a female gonadal shield according to an exemplary embodiment.

FIGS. 10 and 11 illustrate male and female gonadal shields 84 and 86 (respectively). These shields are configured to protect the gonadal region of a user (e.g. patient) during a radiological examination while allowing for visualization of the same area. Gonadal shields 84, 86 include barriers 20 and buffers 40 (respectively).

Figure 12:
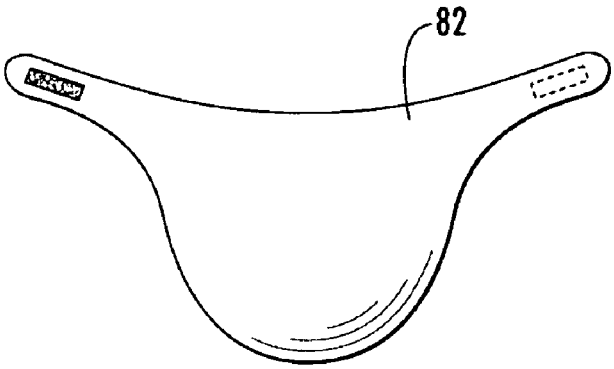
FIG. 12 is a schematic front view drawing of a garment configured as a thyroid shield according to an exemplary embodiment.

FIG. 12 shows a thyroid shield 82. Thyroid shield 82 is configured to protect the thyroid region of a user (e.g. patient) during a radiological examination while allowing for visualization of the same area. Thyroid shield 82 includes barrier 20 and buffer 40.

Figure 13:
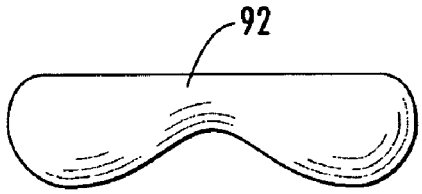
FIG. 13 is a schematic front view drawing of a garment configured as an eye shield according to an exemplary embodiment.

FIG. 13 shows a protective eye shield 92. Eye shield 92 assists in safeguarding the optical anatomy of the user from unwanted or undesirable exposure to the primary radiation beam while allowing for a radiological examination of the same area. Eye shield 92 includes barrier 20 and buffer 40.

Figure 14A:
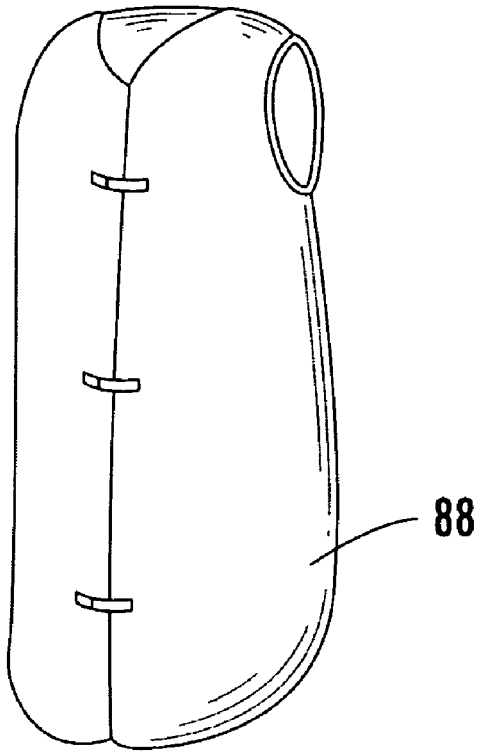
FIG. 14*a* is a schematic perspective view drawing of a garment configured as an apron according to exemplary embodiments.
Figure 14B:
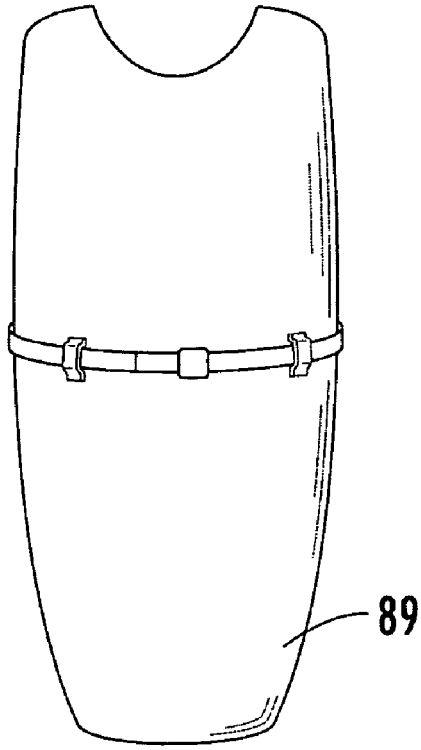
FIG. 14*b* is a schematic front view drawing of a garment configured as an apron according to another exemplary embodiment.

FIGS. 14*a* and 14*b* show protective aprons 88 and 89 (respectively). Aprons 88, 89 are comprised of a shield that encircles the front and/or back of the body of the wearer. Aprons 88, 89 include barriers 20 and buffers 40 (respectively).

Radiation attenuation system 10 may be configured to be disposable in whole or in part, thereby minimizing ancillary sources of contamination that may arise from multiple uses. For example, radiation attenuation system 10 may be configured to allow at least one of barrier 20 and buffer 40 to be retained while the other of barrier 20 and buffer 40 is replaced. If cover 60 is employed, radiation attenuation system may be configured to allow barrier 20 and/or buffer 40 to be retained while cover 60 is replaced. If cover 60 comprises one or more portions (e.g., soft layer, any one or more of the portions may be replaced to allow barrier 20 and/or buffer 40 to be retained.

According to another suitable embodiment, components of radiation attenuation system 10 are generally non-toxic, recyclable, and/or biodegradable. According to an alternative embodiment, the articles of radiation attenuation system may be reusable (e.g. for attenuation of radiation from atomic/nuclear disaster, clean up, rescue operations, etc.). According to a preferred embodiment, the articles of radiation attenuation system 10 (e.g., barrier 20, buffer 40, and/or cover 60, etc.) may be sterilized between uses to minimize the likelihood of bacteriological or virus contamination. Sterilization may be performed in any convenient manner, including gas sterilization and irradiation sterilization.

It is important to note that the construction and arrangement of the elements of the standoff radiation attenuation system as shown in the illustrated embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, or the length or width of the structures and/or members or connectors or other elements of the system may be varied. It should be noted that the elements and/or assemblies of the system may be constructed from any of a wide variety of materials that provide sufficient strength or durability, in any of a wide variety of colors, textures and combinations. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A system for attenuating a primary radiation beam applied to a target area on a patient for generating an image of the target area during a radiological procedure, the system comprising:

a radiation attenuation material positionable over the target area to partially attenuate the primary radiation beam before the primary radiation beam reaches the target area;

a gas layer positionable between the radiation attenuation material and the target area, the gas layer being configured to offset the radiation attenuation material from the target area for improving the clarity of the generated image; and a cover at least partially disposed around the radiation attenuation material and the gas layer.

2. The system of claim 1 wherein the radiation attenuation material is formed of a non-lead material.

3. The system of claim 2 wherein the radiation attenuation material is formed of bismuth.

4. The system of claim 1 wherein the gas layer has a thickness between approximately 0.1 centimeters and approximately 30 centimeters.

5. The system of claim 1 wherein the radiation attenuation material is coupled to the gas layer.

6. The system of claim 1 wherein the radiation attenuation material has an attenuation factor of at least 10 percent of a 100 kVp x-ray beam.

7. The system of claim 6 wherein the radiation attenuation material has an attenuation factor of at least 50 percent of a 100 kVp x-ray beam.

8. The system of claim 7 wherein the radiation attenuation material has an attenuation factor of at least 90 percent of a 100 kVp x-ray beam.

9. A shield for attenuating a primary radiation beam applied to a target area on a patient for generating an image of the target area during a radiological procedure, the shield comprising:

a radiation attenuation material positionable over the target area to partially attenuate the primary radiation beam before the primary radiation beam reaches the target area, the radiation attenuation material having a first surface through which the primary radiation beam is configured to enter and a second surface through which the primary radiation beam is configured to exit; and a gas layer provided beneath the second surface of the radiation attenuation material;

wherein the gas layer is configured to offset the radiation attenuation material from the target area for improving the clarity of the generated image.

10. The shield of claim 9 wherein the radiation attenuation material is formed of bismuth.

11. The shield of claim 9 wherein the gas layer has a thickness between approximately 0.1 centimeters and approximately 30 centimeters.

12. A breast shield for attenuating a primary radiation beam applied to a target area on a female patient for generating an image of the target area during a radiological procedure, the breast shield comprising:

a radiation attenuation material positionable over the target area to partially attenuate the primary radiation beam before the primary radiation beam reaches the target area, the radiation attenuation material having a first surface through which the primary radiation beam is configured to enter and a second surface through which the primary radiation beam is configured to exit; and a gas layer provided beneath the second surface of the radiation attenuation material;

wherein the gas layer is configured to offset the radiation attenuation material from the target area for improving the clarity of the generated image.

13. The breast shield of claim 12 wherein the radiation attenuation material is formed of bismuth.

14. The breast shield of claim 12 wherein the radiation attenuation material is configured to be offset from the female patient a distance between approximately 0.1 centimeters and approximately 30 centimeters.

15. The breast shield of claim 14 wherein the radiation attenuation material is configured to be offset from the female patient a distance between approximately 1 centimeter and approximately 10 centimeters.

16. The breast shield of claim 14 wherein the gas layer has a thickness that is substantially equal to the offset of the radiation attenuation material.

* * * * *